US006196408B1

(12) United States Patent
Setty et al.

(10) Patent No.: US 6,196,408 B1
(45) Date of Patent: Mar. 6, 2001

(54) RELEASE STRIP FOR TUBULAR CONTAINERS AND METHODS AND APPARATUS OF APPLYING SAME

(75) Inventors: Thomas J. Setty, Florence; William C. Suski, Hartsville, both of SC (US); Eric P. Lubitz, Cordova, TN (US); Cossie J. McCorkle, Naperville, IL (US); Gene A. Herron, Florence; Richard M. Lowman, Hartsville, both of SC (US)

(73) Assignee: Sonoco Products Company, Hartsville, SC (US)

( * ) Notice: Subject to any disclaimer, the term of this patent is extended or adjusted under 35 U.S.C. 154(b) by 0 days.

(21) Appl. No.: 08/909,482

(22) Filed: Aug. 11, 1997

Related U.S. Application Data

(63) Continuation-in-part of application No. 29/051,092, filed on Mar. 4, 1996, now Pat. No. Des. 382,202.

(51) Int. Cl.[7] ..... B65D 17/40; B65D 43/08

(52) U.S. Cl. ..... 220/276; 220/270; 229/123.2; 229/125.13; 229/125.22

(58) Field of Search ..... 220/260, 265, 220/266, 276, 270; 206/830; 229/123.2, 125.13, 125.21, 125.22, 245, 5.6, 123.1, 201, 125.01

(56) References Cited

U.S. PATENT DOCUMENTS

| | | | |
|---|---|---|---|
| D. 208,222 | 8/1967 | Slomski . | |
| 211,011 | 12/1878 | Harrison, Jr. . | |
| D. 263,563 | 3/1982 | Ito . | |
| D. 308,828 | 6/1990 | Magnusson . | |
| 771,228 | 10/1904 | Bowers . | |
| 1,622,236 | 3/1927 | Gunter . | |
| 1,734,484 | 11/1929 | Gunter . | |
| 2,086,586 | 7/1937 | Taylor . | |
| 2,355,108 | 8/1944 | Reese . | |
| 2,521,098 * | 9/1950 | Sebell | 220/276 |
| 2,583,873 | 1/1952 | Nichols . | |
| 2,806,620 | 9/1957 | Blanch . | |
| 3,136,469 | 6/1964 | Koenig et al. . | |
| 3,137,432 | 6/1964 | Rein et al. . | |
| 3,142,433 | 7/1964 | Balocca . | |
| 3,172,557 | 3/1965 | Koenig . | |
| 3,189,214 | 6/1965 | Henchert . | |

(List continued on next page.)

FOREIGN PATENT DOCUMENTS

| | | |
|---|---|---|
| 269762 | 10/1950 | (CH) . |
| 637454 | 5/1950 | (GB) . |

*Primary Examiner*—Allan N. Shoap
*Assistant Examiner*—Niki M. Eloshway
(74) *Attorney, Agent, or Firm*—Alston & Bird LLP

(57) ABSTRACT

A release strip for tubular containers is provided and includes a tab portion. An elongate portion of the release strip is releasably adhered to an outer surface of the tubular body of the container with a first adhesive application. The tab portion extends laterally from the elongate portion and is separately releasably adhered to the tubular body with a second adhesive application to prevent the tab portion from being inadvertently snagged. In one preferred embodiment, the tab portion includes an opening therein having an advantageous shape including an arcuate section having at least a predetermined minimum radius of curvature and a substantially straight section opposite the arcuate section, thus allowing sufficient room for accommodating a consumer's finger while maintaining requisite ring strength. An apparatus for manufacturing and applying the release strips also forms a part of the invention and includes first and second adhesive applicators which are offset to apply the first adhesive application to the elongate portion of the release strip and the second adhesive application to the tab portion.

21 Claims, 7 Drawing Sheets

U.S. PATENT DOCUMENTS

| | | | | |
|---|---|---|---|---|
| 3,211,323 | | 10/1965 | Foster . | |
| 3,224,627 | | 12/1965 | Dielmann et al. . | |
| 3,234,858 | | 2/1966 | Rein et al. . | |
| 3,243,075 | | 3/1966 | Reinke . | |
| 3,252,385 | | 5/1966 | Balocca . | |
| 3,259,300 | * | 7/1966 | Pietrzak et al. | 229/125.21 |
| 3,275,184 | | 9/1966 | Henrickson . | |
| 3,302,818 | | 2/1967 | Balocca et al. . | |
| 3,321,102 | | 5/1967 | Simmons . | |
| 3,330,436 | | 7/1967 | Slomski . | |
| 3,334,776 | | 8/1967 | Ellis . | |
| 3,366,269 | | 1/1968 | Slomski . | |
| 3,367,531 | | 2/1968 | Ellis . | |
| 3,378,163 | * | 4/1968 | Griffith | 220/260 |
| 3,403,810 | | 10/1968 | Kehe . | |
| 3,409,200 | | 11/1968 | Balooca et al. . | |
| 3,437,257 | | 4/1969 | Bua . | |
| 3,441,167 | | 4/1969 | Balocca . | |
| 3,460,709 | | 8/1969 | Bieder et al. . | |
| 3,465,910 | | 9/1969 | Richie . | |
| 3,469,727 | | 9/1969 | Acton . | |
| 3,515,334 | | 6/1970 | Jacobson . | |
| 3,519,159 | | 7/1970 | Foss et al. . | |
| 3,562,050 | | 2/1971 | Hake et al. . | |
| 3,593,911 | | 7/1971 | Pellaton . | |
| 3,598,675 | | 8/1971 | Bofinger et al. . | |
| 3,676,271 | | 7/1972 | Hake et al. . | |
| 3,690,997 | | 9/1972 | Bofinger et al. . | |
| 3,812,993 | | 5/1974 | Yoshioka et al. . | |
| 3,831,798 | | 8/1974 | Rowe et al. . | |
| 3,940,004 | | 2/1976 | Faulstich . | |
| 3,964,670 | * | 6/1976 | Amneus | 220/270 |
| 4,024,976 | | 5/1977 | Acton . | |
| 4,069,936 | | 1/1978 | Ota . | |
| 4,103,803 | | 8/1978 | Irvine . | |
| 4,386,706 | | 6/1983 | Korte . | |
| 4,432,466 | | 2/1984 | Allen . | |
| 4,434,908 | | 3/1984 | French . | |
| 4,474,304 | | 10/1984 | Jacobs . | |
| 4,501,375 | | 2/1985 | Katsura et al. . | |
| 4,503,990 | * | 3/1985 | Roth et al. | 220/276 |
| 4,548,333 | | 10/1985 | Kobayashi et al. . | |
| 4,572,393 | * | 2/1986 | Kobayashi et al. | 220/270 |
| 4,732,293 | | 3/1988 | Landis . | |
| 4,759,465 | | 7/1988 | Landis . | |
| 4,790,448 | | 12/1988 | Ostrum et al. . | |
| 4,828,128 | | 5/1989 | Tackles . | |
| 4,890,758 | | 1/1990 | Gailus . | |
| 4,951,836 | | 8/1990 | Yoshimura et al. . | |
| 4,961,512 | | 10/1990 | Von Holdt . | |
| 5,052,574 | | 10/1991 | McKinnon et al. . | |
| 5,069,345 | * | 12/1991 | Irwin | 220/270 |
| 5,085,339 | | 2/1992 | Roth et al. . | |
| 5,145,084 | | 9/1992 | Murayama et al. . | |
| 5,207,340 | | 5/1993 | Cochrane . | |
| 5,253,772 | | 10/1993 | Earnest . | |
| 5,271,517 | | 12/1993 | Bowers . | |
| 5,273,176 | | 12/1993 | Diaz . | |
| 5,373,954 | | 12/1994 | Julian . | |
| 5,385,252 | | 1/1995 | Hidding et al. . | |
| 5,456,375 | | 10/1995 | May . | |
| 5,458,251 | | 10/1995 | Eguchi et al. . | |
| 5,460,287 | | 10/1995 | Cargile et al. . | |
| 5,816,422 | * | 10/1998 | Roig | 220/276 |
| 5,875,914 | * | 3/1999 | Nguyen et al. | 220/276 |
| B1 3,598,675 | | 1/1990 | Bofinger et al. . | |

* cited by examiner

RELEASE STRIP FOR TUBULAR CONTAINERS AND METHODS AND APPARATUS OF APPLYING SAME

CROSS-REFERENCE TO RELATED APPLICATION

This application is a Continuation-In-Part of U.S. patent application Ser. No. 29/051,092, filed Mar. 4, 1996 now U.S. Des. Pat. No. D382,202.

FIELD OF THE INVENTION

The invention relates to tubular containers, and more particularly relates to release strips for removably maintaining end closures on tubular containers and methods and apparatus for applying the release strips to the containers.

BACKGROUND OF THE INVENTION

Food products and other perishable items are often packaged using tubular containers which are sealed at both ends. The tubular containers typically include at least one structural body ply, which is advantageously formed of paperboard, a liner ply on the inner surface of the body ply to provide an impervious barrier to liquids, moisture and some or all gasses, and a label ply around the outside of the body ply for designating the product packaged therein. End closures are applied on both ends to enclose the container.

At least one of the ends is preferably provided with a release strip which allows quick and easy opening of the tubular container by the consumer. These release strips may take several forms, although a common configuration is a release strip which is wrapped around one end of the tubular container before the respective end closure is applied. The end closure is then placed over the end adjacent to the release strip and a generally radially projecting flange of the closure is bent towards the outer surface of the tubular container so as to engage firmly the release strip between the outer surface of the tubular container and the flange. A tab portion is typically provided at one end of the release strip so that a consumer can pull the tab portion and the release strip will be disengaged from between the flange of the end closure and the outer surface of the tubular container. Accordingly, a clearance will be provided between the end closure and the tubular container, and the end closure can then easily be removed.

A typical apparatus for securing release strips to tubular container bodies is disclosed in U.S. Pat. No. 3,690,997 to Bofinger, et al. A roll of plastic web material for the strips is unwound and fed to a cutting member which forms the individual strips. The strips are then advanced in a direction perpendicular to the feed direction of the plastic web material to a vacuum wheel where one entire surface of the strip (having a substantially constant width) is engaged against the peripheral surface of the vacuum wheel. An adhesive is applied to the opposite surface of the release strip by an adhesive roll. An applicator turret rotates the tubular containers against the release strip surface to adhere the release strips to the tubular containers. The adhesive applicator roll is provided with a narrow annular peripheral extension which applies a single adhesive band along the full longitudinal length of the strip including the tab in an area which is disposed adjacent that edge of the strip which is to be farthest removed from the adjacent edge of the tubular body to which the strip will be applied.

In one embodiment, the tab is provided with a circular hole which, when adhered to the container, overlies the opposite end of the release strip. A similar release strip configuration is illustrated in U.S. Des. Pat. No. 208,222 to Slomski. One disadvantage of these container types, however, is that the tab portion provides a limited area for allowing the consumer to initiate and continue removal of the release strip. It is possible for the tab to slip from the grasp of the consumer when pulling on the tab portion. In addition, it has been determined that it is easier to open containers if the tab portion can be twisted relative to the remainder of the release strip during removal thereof. However, the release strips of the prior art have a substantially constant width in the circumferential direction making twisting of the tab portion during removal difficult.

An alternative configuration is disclosed in U.S. Pat. No. 3,409,200 to Balocca et al, wherein a release strip is provided having a slightly enlarged pull tab extending in a direction away from the end closure. An adhesive for adhering the elongate portion of the release strip may be extended to cover the tab and adhere the tab to the container body. This tab configuration may also not provide a sufficiently graspable area to allow the release strip to be easily removed and the tab of this design can also slip from the grasp of the consumer.

If the size of the tab is increased to facilitate better grasping, additional adhesive is required to adhere the enlarged tab to the tubular container, thus adding to the expense of the container. Conversely, if the end portion of an enlarged tab is not adhered to the container, the free end of the tab can become accidentally snagged during the manufacture or subsequent handling of the container such that part of the release strip may be prematurely removed.

One attempt to solve the problem of outwardly extending tabs during handling is disclosed in U.S. Pat. No. 3,330,436 to Slomski. An adhesive bond is provided between the inside surface of the tab and the subjacent tubular container surface and is in alignment with the adhesive band on the elongate portion of the release strip. However, the container of this patent also suffers from having a small tab which can be difficult to grasp. Accordingly, there is a need for a release strip having an easily engaged tab which facilitates removal and eliminates or greatly reduces slipping of the tab from the grasp of the consumer. Such a release strip preferably would not extend outwardly so as to damage or cause partial premature removal of the release strip during handling of the container.

SUMMARY OF THE INVENTION

These and other objects and advantages are met by the release strip according to the present invention and the apparatus and methods associated therewith for applying the release strip to tubular containers. In particular, one aspect of the invention is a tubular container having a release strip with an opening in the tab portion which is large enough to receive and be engaged by the finger of a consumer, thus providing improved removability of the release strip. An advantageous shape for the opening is also a part of the invention and includes an arcuate section to receive the finger of the consumer and an opposite straight section which decreases the extent to which the tab portion extends from the end closure and increases the bonding area for the adhesive. Other embodiments of release strips according to the invention include reduced neck portions adjacent the tab portion to allow twisting of the tab portion during removal of the release strip.

More particularly, the tubular container includes a tubular body having axially opposed ends and inner and outer surfaces, and an end closure adjacent at least one of the ends of the tubular body. The end closure has a flange positioned in spaced adjacency with the outer surface of the tubular body and adjacent to the end. A release strip is removably engaged between the flange and the outer surface of the tubular body. In particular, the release strip includes an elongate portion which is engaged between the flange and the tubular body so that the flange will be released from the tubular body when the release strip is removed.

According to one embodiment, the tab portion of the release strip defines an opening having a sufficient dimension to accommodate a finger of a user therethrough and having a predetermined shape. The predetermined shape of the opening includes an engagement edge opposite from the elongate portion over which the finger of the consumer is inserted and engaged for easily and efficiently removing the release strip from between the end closure and the tubular body. In particular, the shape includes an arcuate section and a substantially straight section opposite the arcuate section. The arcuate section advantageously has a predetermined minimum radius of curvature which is preferably about 0.325 inches, to allow a finger of an average consumer to be engaged in the opening and against the arcuate section. The straight section is aligned in a circumferential direction with one side edge of the release strip so that a substantially constant minimum width is provided for the release strip through both the elongate portion and the tab portion. As a result of this advantageous shape, the opening has a sufficient radius to accommodate a consumer's finger to allow easy removal of the release strip, but also prevents the tab from disadvantageously weakening the ring shaped tab portion adjacent to the end closure or extending outwardly too far from the end closure.

Advantageously, the release strip is configured such that the tab portion has a width (extending in the axial direction of the tubular container) which is at least 2.0 times the width of the elongate portion. Such a configuration ensures sufficient graspability of the tab portion for easy removal of the release strip. More preferably, the ratio of tab portion width to elongate portion width is at least about 3.0.

Other embodiments of the release strip include a neck portion connected to the elongate portion and a head portion connected to the neck portion. Advantageously, the neck portion has a minimum width less than about 75% of the width of the elongate portion to facilitate twisting of the tab portion relative to the elongate portion during removal of the release strip. In one particular embodiment, the tab portion is generally T-shaped and the head portion has a longitudinal dimension extending perpendicularly to the elongate portion. In another embodiment, the head portion has a longitudinal dimension which extends at an acute angle relative to the elongate portion.

The elongate portion of the release strip is preferably releasably adhered to the outer surface of the tubular body with a first area of adhesive. The tab portion extends laterally from the elongate portion and is advantageously separately releasably adhered to the tubular body with a second area of adhesive, thus preventing the tab portion from becoming snagged during manufacture and shipment of the tubular container. A third area of adhesive between the first and second areas of adhesive may further adhere the tab portion to the outer surface of the tubular body.

The apparatus according to the present invention includes first and second adhesive applicators which are offset from each other to apply a first area of adhesive to an elongate portion of the release strip and a second area of adhesive to the laterally extending tab portion of the release strip. As such, the release strips are advantageously adhered to the tubular container at two different locations so that the tab portion is prevented from being snagged.

The apparatus for applying release strips to tubular container bodies more particularly includes a supply source of release strips for supplying a succession of release strips in an end-to-end relationship. The supply source may include a supply reel of continuous release strip material and a punch press having a plurality of progressive dies. The release strip material is advantageously supplied at an angle relative to the punch press so that successive release strips can be nested to reduce waste, even with the enlarged tab portions according to the present invention.

From the supply source, the succession of release strips are received on a peripheral surface of a vacuum wheel. The vacuum wheel is rotatable about an axis and defines a plurality of vacuum openings in the peripheral surface which are aligned with the supply source. Accordingly, the elongate portions of the release strips are releasably held against the peripheral surface of the vacuum wheel and the tab portions extended laterally therefrom in an axial direction.

A first adhesive applicator is positioned adjacent to the peripheral surface of the vacuum wheel for applying adhesive along the elongate portions of the release strips as the strips pass the applicator. A second adhesive applicator is provided offset from the first adhesive applicator in the direction of the vacuum wheel axis. The second adhesive applicator applies adhesive to the laterally extending tab portions of the release strips.

The release strips are then advanced adjacent to a carrier wheel which carries a succession of tubular container bodies in a tangent relationship to the release strips on the vacuum wheel. The elongate portion and the tab portion of each release strip are thus adhered to a respective tubular container body. The apparatus may advantageously further include a third adhesive applicator for applying adhesive to the tab portions of the release strips between the first and second adhesive applicators.

Accordingly, great advantages are provided by the release strip according to the present invention and the associated apparatus and methods for applying the release strip to the tubular containers.

BRIEF DESCRIPTION OF THE DRAWINGS

Some of the objects and advantages of the invention have been set forth and other objects and advantages of the invention will become apparent in the detailed description of the preferred embodiments of the invention to follow, when taken in conjunction with the accompanying drawings, which are not necessarily drawn to scale.

DETAILED DESCRIPTION OF THE EMBODIMENTS

Figure 1:
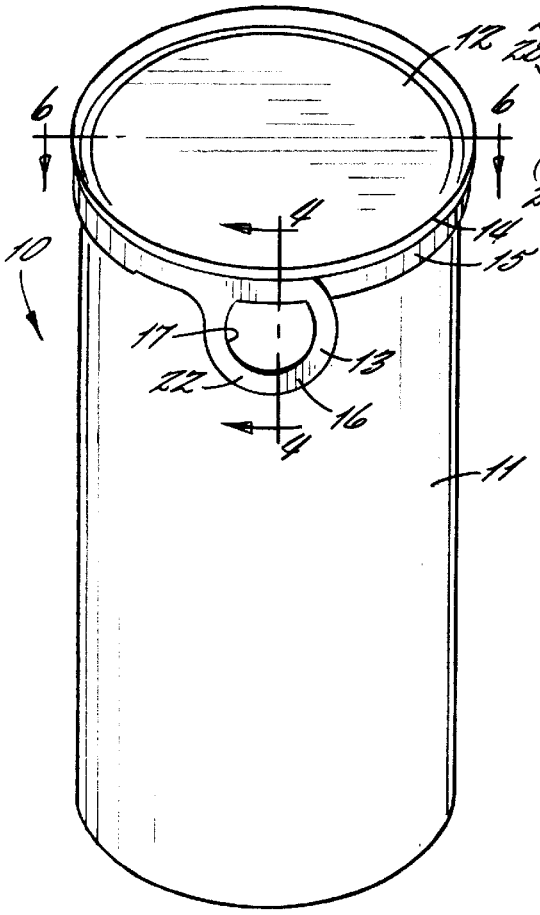
FIG. 1 is a perspective view of a tubular container according to the present invention.

Various embodiments relating to the invention are set forth below. While the invention is described with reference to specific preferred embodiments, including those illustrated in the drawings, it will be understood that the invention is not intended to be so limited. To the contrary, the invention includes numerous alternatives, modifications, and equivalents as will become apparent from consideration of the present specification including the drawings, the foregoing discussion, and the following detailed description.

The tubular container 10 according to the present invention is illustrated in FIG. 1 and includes a tubular body 11, an end closure 12 and a release strip 13. The tubular body 11 is preferably formed from paperboard and can have one or more structural body plies. The tubular body 11 may also include a liner ply on the inner surface of the body ply to provide an impervious barrier to liquids, moisture and gasses and a label ply around the outside of the body ply for designating the product packaged therein.

Figure 4:
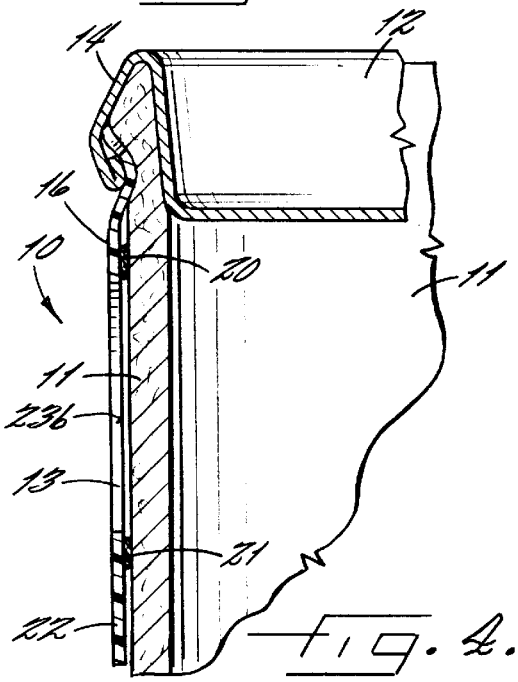
FIG. 4 is an enlarged sectional view of the release strip and an end closure of the tubular container taken along lines 4—4 of FIG. 1.

An end closure 12 can be fitted at one or both ends of the tubular body 11. The end closure 12 is preferably formed of metal and includes a flange 14 which extends over the end of the tubular body 11. The flange 14 includes one or more bends therein to create a seamed end closure 12 which is frictionally engaged to the tubular body 11. In particular, the flange 14 is bent over to engage the release strip 13 against the tubular body 11, as can be seen in FIG. 4. The end closure 12 can thus be removed from the body 11 by first removing the release strip 13.

Figure 2:
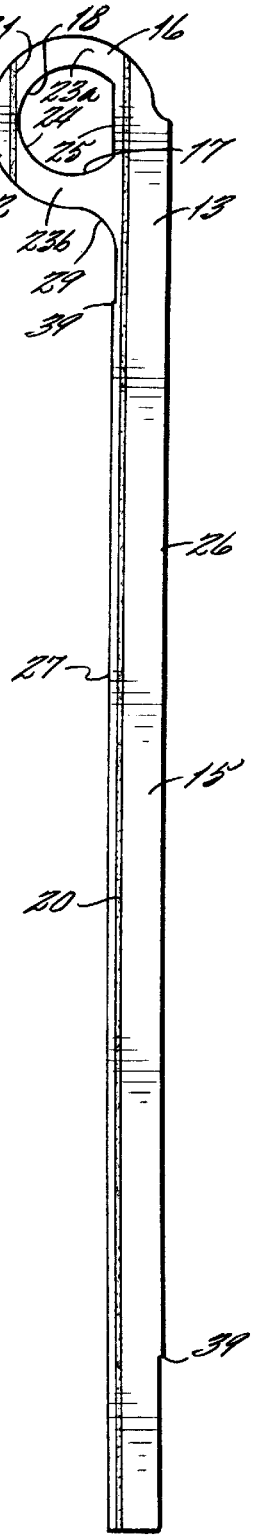
FIG. 2 is a plan view of a release strip according to the present invention illustrating the placement of first and second areas of adhesive.
Figure 3:
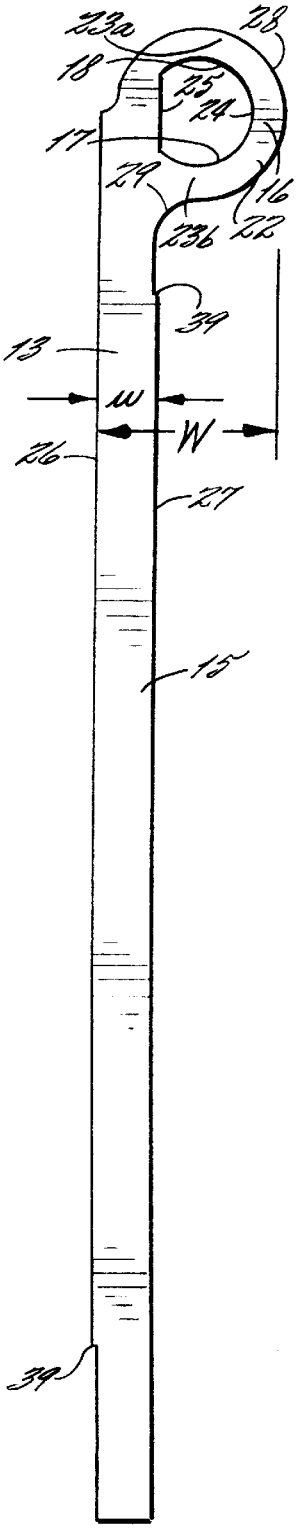
FIG. 3 is a plan view of the opposite side of the release strip illustrated in FIG. 2.

The release strip 13 is shown in more detail in FIGS. 2 and 3 and includes an elongate portion 15 and a tab portion 16. As can be seen in FIGS. 2 and 4, a first area of adhesive 20 is provided along the length of the elongate portion 15 of the release strip 13. The first area of adhesive 20 may be substantially continuous as shown or comprise intermittent segments of adhesive along the length of the release strip 13. The first area of adhesive 20 thus adheres the release strip 13 to the end of the tubular body 11 before the end closure 12 is applied, as discussed in more detail below.

One highly beneficial feature of the present invention with which may be employed with any of the release strip 13 embodiments disclosed herein, is a second area of adhesive 21 which is spaced in the axial direction of the container 10 from the first area of adhesive 20. The tab portion 16 extends laterally from the elongate portion 15 by a distance which allows adequate grasping of the tab portion by a consumer. In particular, a distal section 22 of the ring shaped tab portion 16 may extend one inch or more from the elongate portion 15, which provides enhanced graspability for the consumer. Without the second area of adhesive 21, such an enlarged tab portion 16 could become snagged during manufacture and handling (either on the machinery or with an adjacent can). Snagging can be detrimental to the release strip 13 and/or the container 10 and can cause costly and inefficient manufacturing delays. The second area of adhesive 21 causes the distal arcuate section 22 to be releasably adhered to the tubular body 11 and prevents the tab portion 16 from being snagged.

Figure 5:
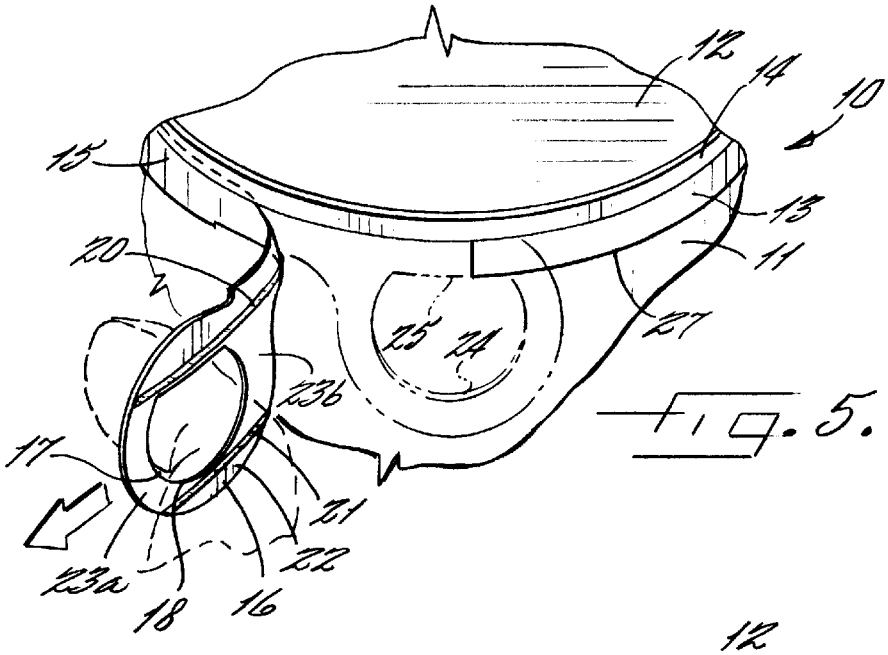
FIG. 5 is an enlarged perspective view of a portion of the tubular container illustrating the removal of the release strip.

The tubular container 10 is opened in the manner illustrated in FIG. 5. Specifically, the consumer first places a finger through the ring shaped tab portion 16 of the release strip 13. The tab portion 16 defines an opening 17 having a sufficiently large dimension to accommodate a finger of a consumer therethrough. The opening 17 preferably has a predetermined shape which includes an engagement edge 18. The finger of the consumer is inserted in the opening 17 over the engagement edge 18 and then pulled against the engagement edge for removing the release strip 13. The consumer continues to pull the tab portion 16 to disengage the elongate portion 15 of the release strip 13 from between the flange 14 and the tubular body 11. Once the release strip 13 has been fully removed, it will be appreciated that a space is created between the flange 14 and the tubular body 11. Accordingly, the end closure 12 can be easily removed from the end of the tubular body 11 and the contents of the container 10 can be removed from that end of the container.

The opening 17 can be of any size and shape which facilitates insertion and engagement by a finger although one particularly advantageous shape can be seen in FIGS. 2 and 3. The tab portion 16 includes the distal section 22 and opposite side sections 23*a*,23*b*. The opening 17 in the tab portion 16 includes an arcuate section 24 and a substantially straight section 25 opposite the arcuate section. The arcuate section 24 has a predetermined minimum radius of curvature which is preferably constant throughout for accommodating a finger of an average consumer. It has been determined that a constant radius of between about 0.25 inches and 0.50 inches, and more particularly about 0.325 inches, is a suitable radius.

The release strip 13 includes first and second side edges 26,27 which are parallel to each other and, when adhered to the container 10, are offset in the direction of the axis of the container. The straight section 25 of the opening in the ring shaped tab portion 16 and the second side edge 27 are advantageously aligned (in a circumferential direction relative to their positions on the container 10) so that the release strip 13 has a predetermined minimum width along substantially the entire length of the release strip 13. The straight section 25 enhances the strength of the ring shaped tab portion 16 and provides an increased bonding surface area which corresponds to the underlying opposite end of the release strip 13. In addition, the straight section 25 allows the opening 17 to have an arcuate section 24 of a certain predetermined minimum radius of curvature without causing the tab portion 16 to extend as far as it would if the opening was a complete circle of the same radius.

The outer contour of the release strip 13 includes a generally convex arcuate section 28 extending around the ring shaped tab portion 16. The outer contour also includes a concave arcuate section 29 which blends the convex arcuate section 28 into the second side edge 27 of the elongate portion 15 to prevent tearing of the release strip 13.

Thus, the novel shape of the opening of the ring shaped tab portion 16 successfully balances certain design considerations to create a highly advantageous release strip. The arcuate section 24 has a predetermined minimum radius which has been determined to suitably accommodate the finger of an average consumer but which does not extend too far from the end closure 12 in the axial direction of the container 10. As would be appreciated, however, other opening shapes could be used including complete circles, ovals, ellipses or any other shapes which could accommodate the finger of a consumer.

Figure 10:
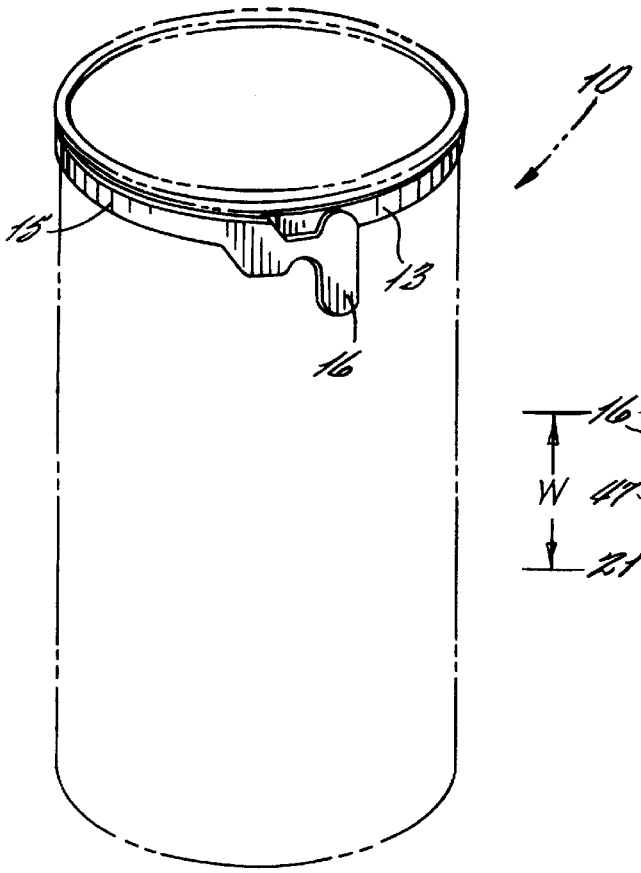
FIG. 10 is a perspective view of an alternative embodiment of the release strip.
Figure 10A:
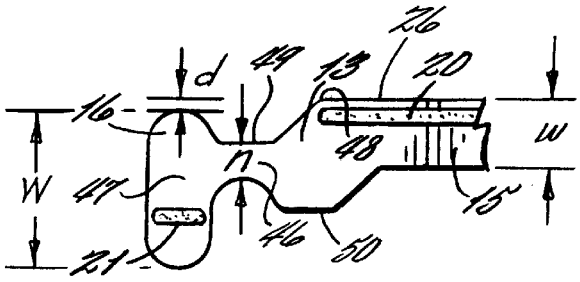
FIG. 10A is an enlarged plan view of a portion of the release strip embodiment illustrated in FIG. 10.
Figure 11:
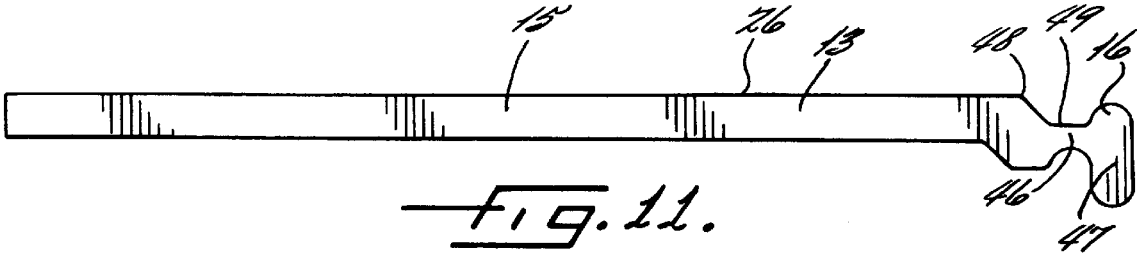
FIG. 11 is a plan view of the release strip embodiment illustrated in FIG. 10.

Alternative embodiments of the release strip 13 are illustrated in FIGS. 10–13. FIGS. 10, 10A and 11 illustrate a first alternative embodiment having a generally T-shaped tab portion 16. A first area of adhesive 20 extends along the elongate portion 15 of the release strip 13 and a second area of adhesive 21 is provided on a distal part of the T-shaped tab portion 16.

Figure 12:
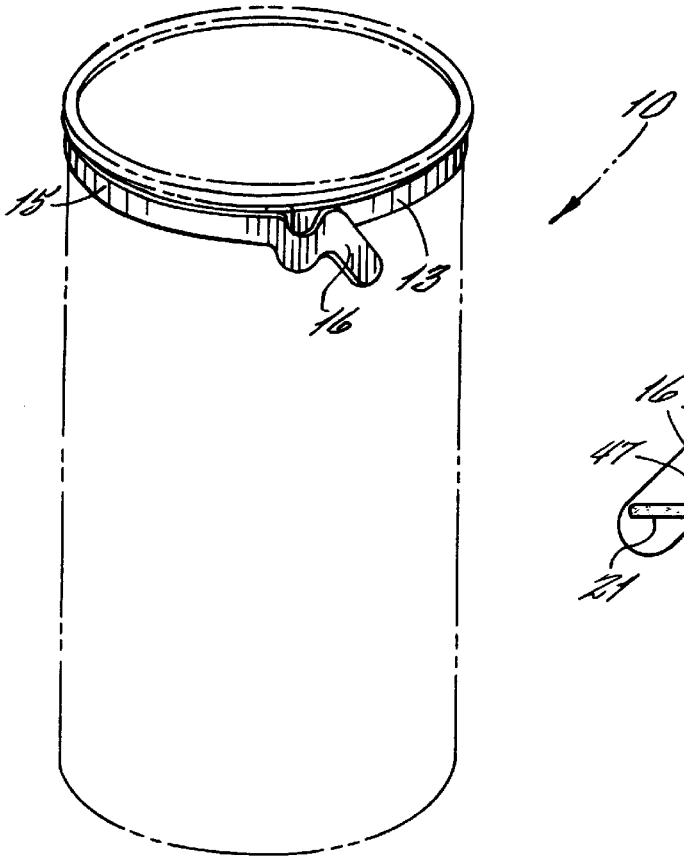
FIG. 12 is a perspective view of an alternative embodiment of the release strip.
Figure 12A:
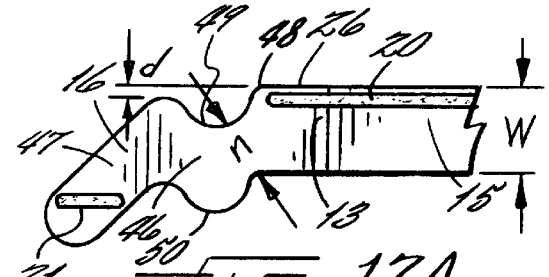
FIG. 12A is an enlarged plan view of a portion of the release strip embodiment illustrated in FIG. 12.
Figure 13:
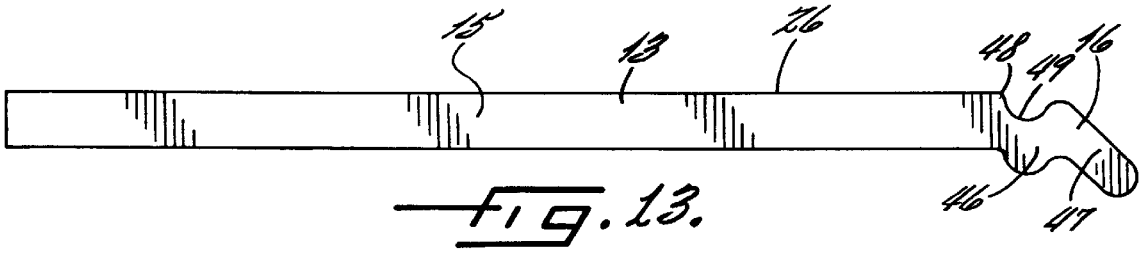
FIG. 13 is a plan view of the release strip embodiment illustrated in FIG. 12.
Figure 14:
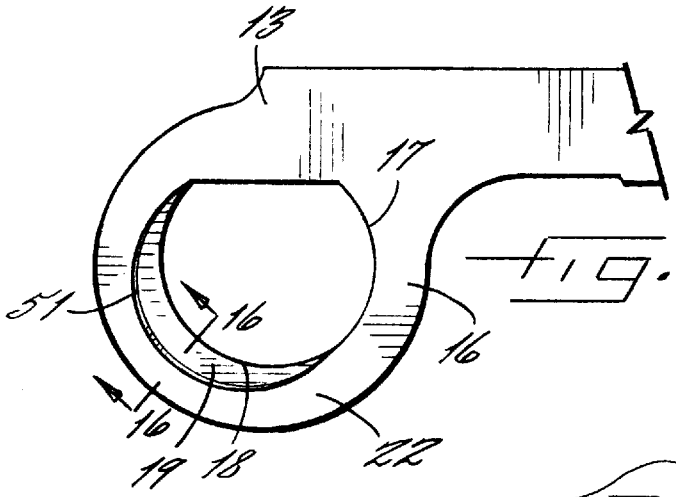
FIG. 14 is a greatly enlarged plan view of a portion of a release strip illustrating a pliable engagement portion of the tab portion adjacent to the opening therein.
Figure 15:
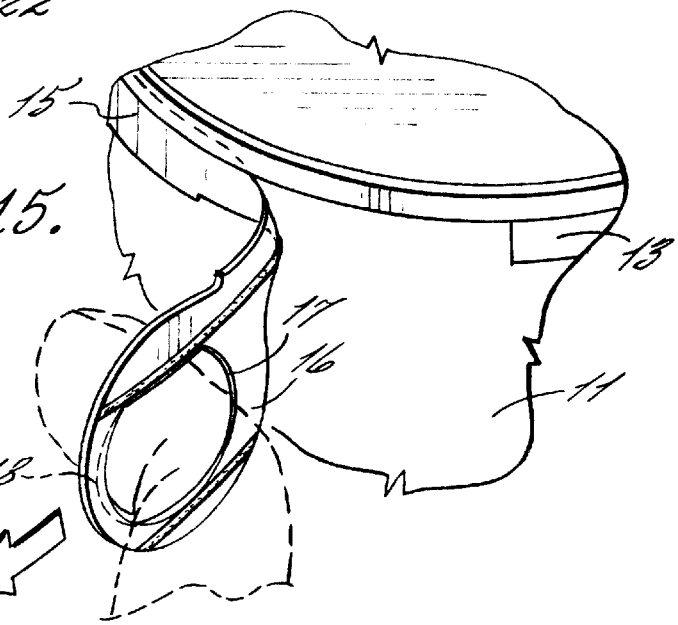
FIG. 15 is a perspective view of a portion of the tubular container illustrating the removal of the release strip of FIG. 14.
Figure 16:
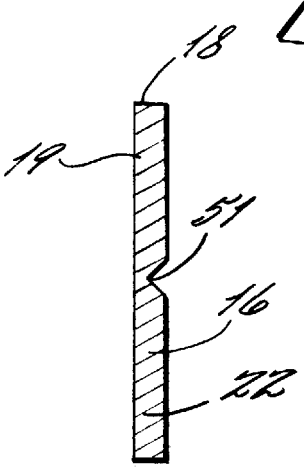
FIG. 16 is a sectional view of the release strip taken along line 16—16 of FIG. 14.
Figure 17:
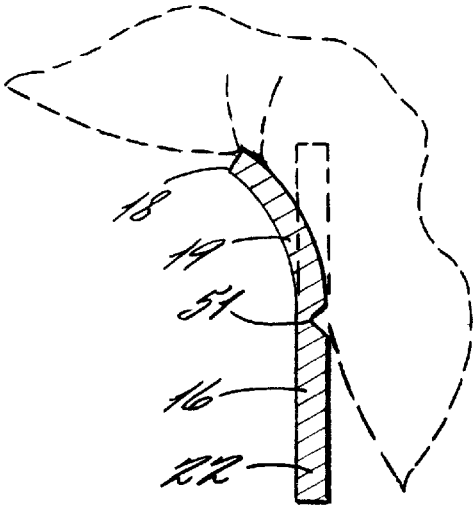
FIG. 17 is a sectional view of the release strip illustrating how the pliable engagement portion of the tab portion bends when the release strip is engaged by the finger of a consumer.
Figure 18:
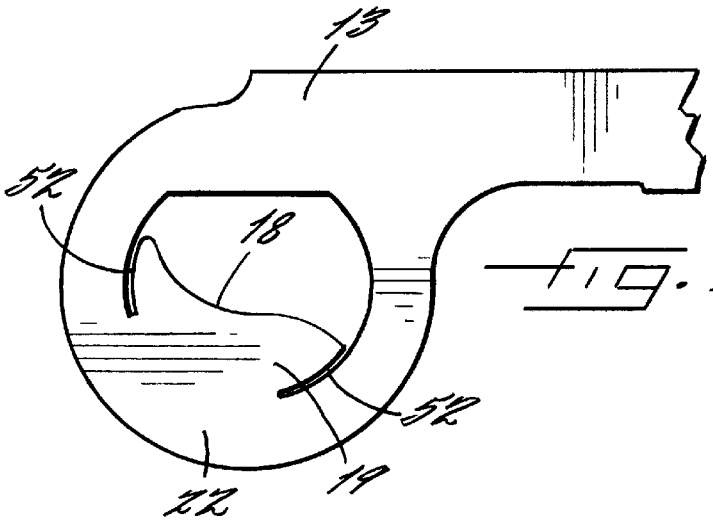
FIG. 18 is a plan view of a release strip having a different embodiment of the pliable engagement portion.
Figure 19:
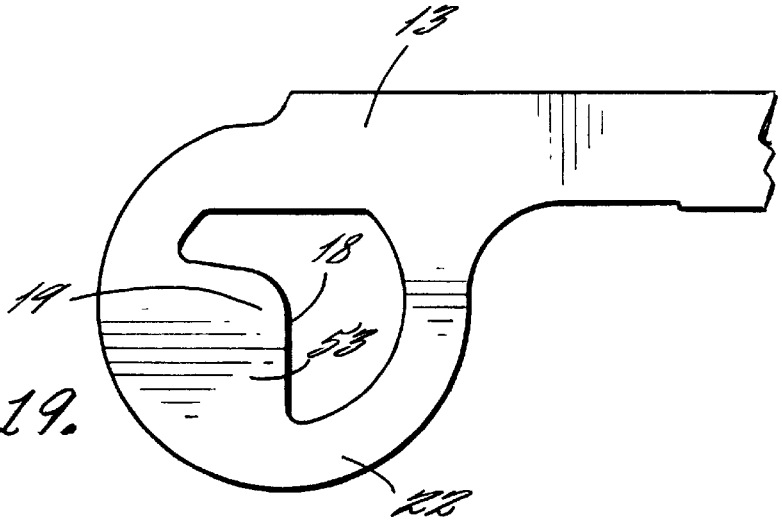
FIG. 19 is a plan view of a release strip having a different embodiment of the pliable engagement portion.
Figure 20:
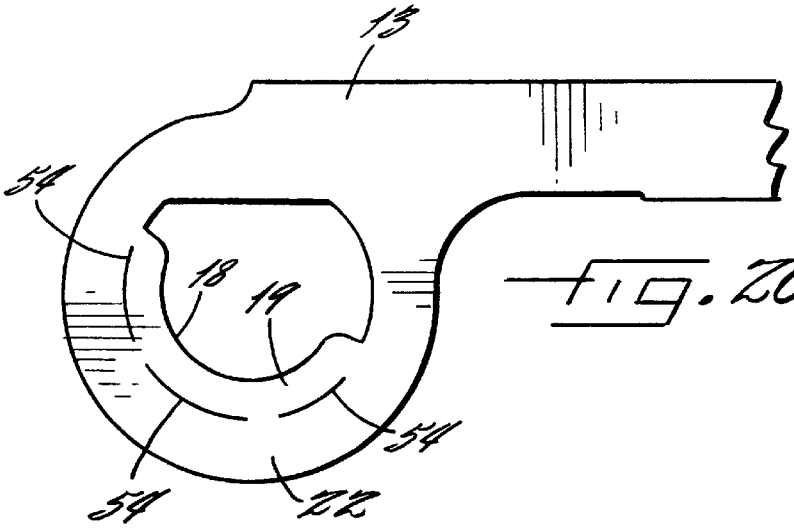
FIG. 20 is a plan view of a release strip having another embodiment of the pliable engagement portion.

A second alternative embodiment is illustrated in FIGS. 12, 12A and 13 and includes an inclined tab portion 16. A first area of adhesive 20 is provided on the elongate portion 15 and a second area of adhesive 21 is provided on a distal part of the inclined tab portion 16. These alternative embodiments can be manufactured with the apparatus and in accordance with the methods described above.

An important consideration for release strips is that the tab portion should extend sufficiently in the axial direction to allow a consumer to firmly grip and remove the release strip. The release strips 13 according to the present invention provide for excellent gripping and it has been determined that the width of the tab portion 16 in the axial direction of the container (denominated W in FIGS. 3 and 10*a*) is preferably larger than the width of the elongate portion w by a multiple of at least about 2.0. For example, the release strip embodiment of FIGS. 10–11 may have a tab width of W=0.750 inches and an elongate portion width of w=0.312 inches for a W/w ratio of 2.4. Even more preferably, the release strip has a W/w ratio of at least 3.0. The release strip embodiment of FIGS. 1–5 may be sized such that W=1.056 inches and w=0.312 inches for a W/w ratio of 3.4.

It has also been determined that, for removal of the release strip 13, a preferred technique is to twist the tab portion 16 relative to the elongate portion 15. The twisting action can enhance the consumer's grip and leverage for removing the release strip 13. Accordingly, the tab portions of the release strip embodiments of FIGS. 10–13 provide for improved twisting and preferably include a reduced neck portion 46 and a head portion 47 which can be easily twisted relative to the elongate portion 15 during removal. It has been determined that the minimum width n of the neck portion 47 is preferably less than about 75% of the width W of the elongate portion 15 for improved twisting. For example, the embodiment of FIGS. 10–11 may be sized such that n=0.156 inches and W=0.312 inches and the neck width is 50% of the elongate portion width. The embodiment of FIGS. 12–13 may have n=0.260 inches and w=0.428 inches such that the relationship is approximately 61%.

The reduced neck portion 46 of FIGS. 10–13 is also preferably recessed relative to the first side edge 26 of the elongate portion 15. In particular, the first side edge 26 terminates at a shoulder 48. The neck portion 46 defines an axially recessed contour 49 facing in the direction of the end closure 12. The recessed contour 49 begins at the shoulder 48 and terminates at the head portion 47 such that at least a part of the head portion is closer to the end closure 12 than the recessed contour 49. A generally convex contour 50 is advantageously provided opposite the recessed contour 49 so that the release strip 13 can be nested during formation thereof, as is discussed below. The head portion 47 is preferably as close to the end closure 12 as possible (without being engaged between the end closure and the tubular body 11) to improve the removability of the release strip 13. In particular, the part of the head portion 47 closest to the end closure 12 is preferably within about 0.1 inches of an imaginary line circumferentially extending from the first side edge 26. This distance is denoted by d in FIGS. 10A and 12A. The distance d is more preferably about 0.06 inches.

One advantage of this configuration is that the shoulder 48 may be positioned closely adjacent to the opposite end of the elongate portion 15, as can be seen in FIGS. 10 and 12. It is preferable for proper sealing of tubular containers of this type to engage only one thickness of release strip material between the end closure 12 and the tubular body 11 around substantially the entire periphery of the tubular body. Thus, if the neck portion 46 was not recessed, the shoulder 48 would be much closer to the adjacent end of the release strip 13 and the amount of release strip that would extend circumferentially past the opposite end of the release strip would be greatly reduced. As such, the adhesive would also extend much closer to the free end of the release strip 13 and the release strip 13 would be much more difficult to remove.

The release strip 13 preferably has a thickness of at least about 0.015 inches, which has been determined to be thick enough to present little risk of cutting a consumer's finger, although other thicknesses may be used depending upon the specific application.

A related advantageous feature of the invention is illustrated in FIGS. 14–20 wherein the engagement edge 18 defines an edge of a pliable engagement portion 19 extending at least partially from the distal section 22. Advantageously, the engagement portion 19 is pliable and bends in the manner illustrated in FIGS. 15 and 17 when a finger of the consumer is engaged against the engagement edge 18. The bending of the pliable engagement portion 19 provides a greater surface area for engagement with the finger and ensures that the engagement edge 18 does not cut the finger of the consumer.

The embodiment of the pliable engagement portion 19 illustrated in FIGS. 14–17 includes an arcuate groove 51 or score which reduces the thickness of the release strip 13 and increases the flexibility along that groove 51. The embodiment of FIG. 18 includes a pair of arcuate cuts 52 which define the pliable engagement portion 19. The embodiment of FIG. 19 includes a pliable protrusion 53 extending from the distal section 22 of the tab portion 16. The embodiment of FIG. 20 includes a pliable engagement portion 19 extending outwardly from the distal section 22 and a plurality of slits 54 for reducing the stiffness of the material and increasing the pliability. Various other ways of forming a pliable engagement portion 19 would be apparent to one of ordinary skill in the art including coining or pressing part of the release strip 13 adjacent the engagement edge 18 to reduce the original thickness of the material.

Figures 7, 8, 9:
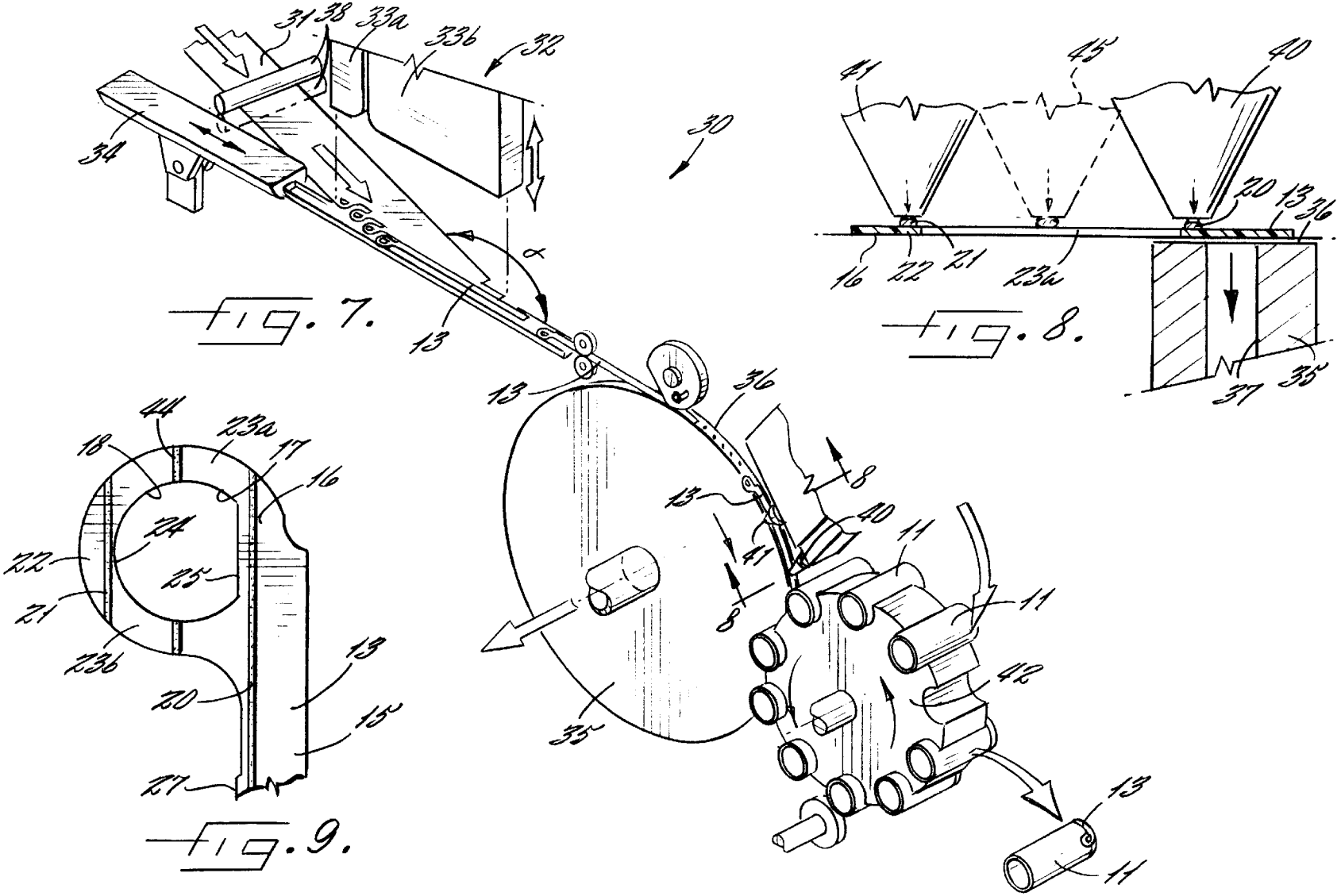
FIG. 7 is a perspective view of an apparatus according to the present invention for applying the release strips to tubular containers.
FIG. 8 is a partial sectional view of first and second adhesive applicators taken along lines 8—8 of FIG. 7.
FIG. 9 is a greatly enlarged plan view of a portion of a release strip provided with three areas of adhesive.

An apparatus 30 and method according to another aspect of the invention for forming and applying release strips 13 is illustrated in FIGS. 7 and 8. The apparatus includes many components which are common with the apparatus disclosed in U.S. Pat. No. 3,690,997 to Bofinger, et al. (which is incorporated herein by reference) but also includes several modifications which provide advantages over the conventional apparatus. The apparatus includes a supply source of a continuous web of release strip material 31. It has been determined that a suitable release strip material 31 is high density polyethylene (HDPE) although other materials could be used, such as polyester or other suitable polymers and laminates thereof. The release strip material 31 is advanced in a feed direction by servo driven feed rollers 38 to a punch press 32, which forms the individual release strips 13.

Preferably, the punch press 32 includes a plurality of progressive dies 33*a*,33*b* for forming the advantageous shape of the release strip 13 according to the invention. To enhance the operation of the progressive dies 33*a*,33*b*, the release strips 13 may include various small offsets 39 in the outer contour. A pusher bar 34 advances the individual release strips in an end-to-end relationship to a vacuum wheel 35 along a predetermined path of travel.

The feed direction of the web material 31 is preferably offset from the path of travel of the release strips 13 by an obtuse angle $\alpha$. The obtuse angle $\alpha$ is preferable to prior apparatus where the web material 31 was fed perpendicularly to the release strips 13 because it allows the release strips to be formed from a narrower web of material without excessive scrap being generated. In particular, the angled approach for the web material 31 allows the release strips 13 to be efficiently nested, even though the release strips include generally large tab portions 16. The nesting can be seen in FIG. 7 and allows the punch press 32 to create both the trailing edge of the elongate portion of one release strip and the leading edge of the elongate portion of the next successive release strip with a single cut and minimal scrap. Increasing the obtuse angle $\alpha$ generally increases the size of the tab portion 16 which can be made while still maintaining the nestability of the release strips 13. It has been determined that an obtuse angle $\alpha$ of at least about 135° is preferred, and more particularly an angle $\alpha$ of about 158°.

The vacuum wheel 35 includes a peripheral surface 36 defining a plurality of vacuum openings 37 therein, each of which is connected to a vacuum source. Accordingly, the elongate portions 15 of the release strips 13 are releasably held against the peripheral surface 36 by the vacuum openings 37. The laterally extending tab portions 16 preferably extend laterally in an axial direction beyond the edge of the peripheral surface 36 of the vacuum wheel 35, as can be seen in FIG. 8.

A first adhesive applicator 40 is positioned adjacent to the peripheral surface 36 of the vacuum wheel 35 for applying adhesive along the elongate portions 15 of the release strips 13 as the strips pass the applicator. As noted above, the first area of adhesive 20 can be substantially continuous along the length of the release strip 13 or can be comprised of a succession of intermittent segments.

Advantageously, a second adhesive applicator 41 is provided at a position which is offset in the direction of the axis of the vacuum wheel 35 from the first adhesive applicator 40. As shown in FIG. 7, the adhesive applicators 40,41 may also be offset in a circumferential direction relative to the vacuum wheel 35. The second adhesive applicator 41 is preferably an adhesive gun which is triggered as the release strips 13 pass thereunder so that adhesive is intermittently released onto the tab portion 16. In this fashion, only a minor amount of additional adhesive for the second area of adhesive 21 is required.

After the first and second adhesive applicators 40,41, the strips are passed to a carrier wheel 42 which carries a succession of tubular container bodies 11 in a tangent relationship to the release strips 13 on the vacuum wheel 35. The container bodies 11 are rotated against the release strips 13 so that each release strip will be adhered to one end of a respective tubular body 11. From the carrier wheel 42, the tubular bodies and adhered release strips 13 are advanced to a conventional seaming apparatus for applying end closures 12 over the release strip 13 of each tubular body 11. The container 10 is then filled with product and the opposite end of the container is sealed with a suitable end closure.

Figure 6:
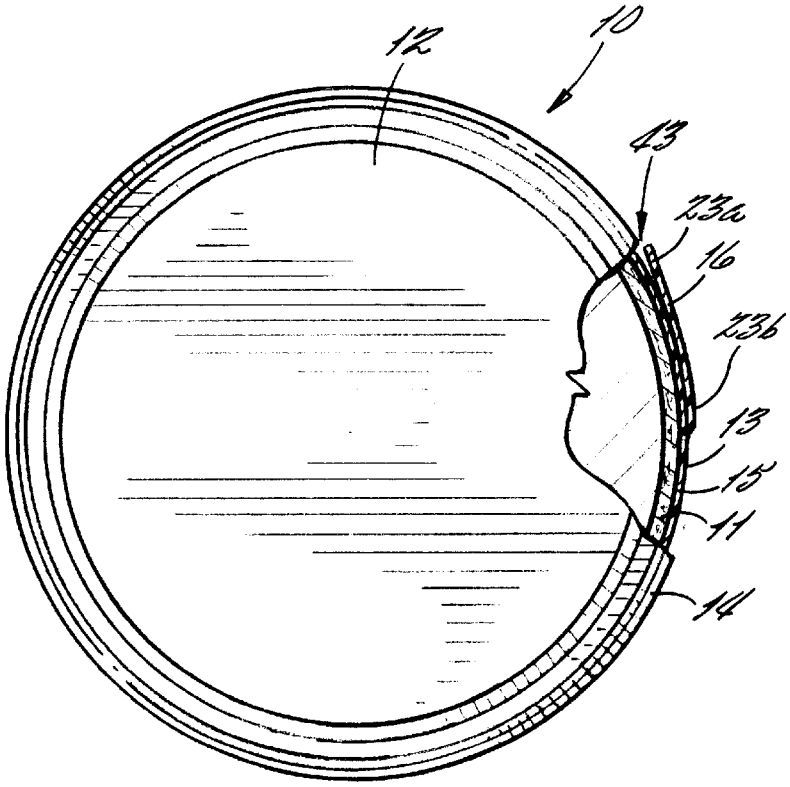
FIG. 6 is a partial sectional view of the release strip taken along lines 6—6 of FIG. 1.

With reference to FIG. 6, the first and second areas of adhesive 20,21, in combination with the stiffness of the release strip material, cause a side section 23*a* of the release strip to extend slightly outwardly from the cylindrical surface of the body 11 so as to create a slight separation 43 from the body. The separation 43 can be preferable for allowing the consumer to place a fingernail or fingertip under the tab portion 16 to begin the removal of the release strip. In certain applications, however, the separation 43 may not be desirable, and a third area of adhesive 44 is applied to the side sections 23*a*,23*b* of the tab portion 16 between the first and second areas of adhesive 20,21, as shown in FIG. 9, by a third adhesive applicator 45, as shown in FIG. 8. The third area of adhesive 44 ensures substantial conformity of the tab portion 16 with the cylindrical outer surface of the tubular body 11. In certain situations, it may also be desirable to eliminate the second area of adhesive 21 so that the distal arcuate section 22 can extend only slightly outwardly from the third area of adhesive 44.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tubular container comprising:

a tubular body having axially opposed ends and inner and outer surfaces;

an end closure adjacent at least one of the ends of said tubular body and having a flange positioned in spaced adjacency with the outer surface of said tubular body adjacent to said one end; and a release strip removably engaged between said flange and the outer surface of said tubular body so that said flange will be released from said tubular body when said release strip is removed, said release strip having an elongate portion which is engaged between said flange and said tubular body and a tab portion extending laterally from said elongate portion generally adjacent to said tubular body, said tab portion defining an opening having a sufficient dimension to accommodate a finger of a consumer therethrough and having a predetermined shape, said predetermined shape including a substantially straight section that partially defines said opening and is adjacent to said elongate portion, and an opposite arcuate section having a predetermined minimum radius of curvature and defining an arcuate engagement edge that partially defines said opening and over which the finger of the consumer is inserted and engaged for removing said release strip from between said end closure and said tubular body.

2. A tubular container as defined in claim 1 wherein said elongate portion is releasably adhered to the outer surface of said tubular body with a first area of adhesive between said elongate portion and said tubular body and further wherein said tab portion is separately releasably adhered to said tubular body with a second area of adhesive between said tab portion and said tubular body.

3. A tubular container as defined in claim 2 wherein said tab portion is generally ring shaped and further comprises a distal section spaced from said elongate portion, and wherein said second area of adhesive adheres said distal section to the outer surface of said tubular body.

4. A tubular container as defined in claim 3 wherein said ring shaped tab portion further comprises opposite side sections between said distal section and said elongate portion, and further comprising third areas of adhesive which adhere each of said opposite side sections of said ring shaped tab portion to the outer surface of said tubular body.

5. A tubular container as defined in claim 3 wherein said ring shaped tab portion further comprises opposite side sections between said distal section and said elongate portion and wherein at least one of said opposite side sections of said ring shaped tab portion is separated from the outer surface of said tubular body.

6. A tubular container as defined in claim 1 wherein said elongate portion of said release strip has a first side edge adjacent said one end of said tubular body and a second side edge axially offset from said first side edge, and wherein said straight section that partially defines the opening in said tab portion is aligned in a circumferential direction with said second side edge of said release strip.

7. A tubular container as defined in claim 1 wherein said arcuate section of the opening of said tab portion has a constant radius of curvature of between about 0.25 inches and 0.5 inches.

8. A tubular container as defined in claim 7 wherein said arcuate section of the opening of said tab portion has a constant radius of curvature of about 0.325 inches.

9. A tubular container comprising:

a tubular body having axially opposed ends and inner and outer surfaces;

an end closure adjacent at least one of the ends of said tubular body and having a flange positioned in spaced adjacency with the outer surface of said tubular body adjacent to said one end; and a release strip removably engaged between said flange and the outer surface of said tubular body so that said flange will be released from said tubular body when said release strip is removed, said release strip having an elongate portion which is engaged between said flange and said tubular body and which has a predetermined width in the axial direction of said tubular body, said release strip being releasably adhered to said tubular body with a first discrete area of adhesive between said elongate portion and the outer surface of said tubular body and a tab portion extending laterally from said elongate portion generally adjacent to said tubular body and releasably adhered to the outer surface of said tubular body with a second discrete area of adhesive separate from said first area of adhesive and spaced apart from said first area of adhesive in the axial direction of said tubular body, said tab portion having a width in the axial direction of said tubular body greater than the width of said elongate portion in the same direction such that the ratio of the tab portion width to the elongate portion width is at least about 2.0.

10. A tubular container as defined in claim 9 wherein the ratio of the tab portion width to the elongate portion width is at least about 3.0.

11. A tubular container as defined in claim 9 wherein said tab portion is generally ring shaped and defines an opening having a sufficient dimension to accommodate a finger of a consumer therethrough.

12. A tubular container as defined in claim 9 wherein said tab portion is generally T-shaped and includes a neck portion connected to said elongate portion and a transverse head portion connected to said neck portion.

13. A tubular container as defined in claim 9 wherein said release strip has a thickness of at least about 0.015 inches.

14. A tubular container comprising:

a tubular body having axially opposed ends and inner and outer surfaces;

an end closure adjacent at least one of the ends of said tubular body and having a flange positioned in spaced adjacency with the outer surface of said tubular body adjacent to said one end; and a release strip removably engaged between said flange and the outer surface of said tubular body so that said flange will be released from said tubular body when said release strip is removed, said release strip having an elongate portion which is engaged between said flange and said tubular body and a tab portion extending from said elongate portion generally adjacent to said tubular body for grasping and pulling by the consumer to remove the release strip, said tab portion having a neck portion connected to said elongate portion and a head portion connected to said neck portion, said neck portion having a minimum width less than about 75% of the width of the elongate portion to facilitate twisting of the tab portion relative to the elongate portion during removal of the release strip, wherein said tab portion is generally T-shaped and said head portion has a longitudinal dimension extending perpendicularly to said elongate portion.

15. A tubular container as defined in claim 14 wherein said head portion is offset and has a longitudinal dimension which extends at an acute angle relative to said elongate portion.

16. A tubular container comprising:

a tubular body having axially opposed ends and inner and outer surfaces;

an end closure adjacent at least one of the ends of said tubular body and having a flange positioned in spaced adjacency with the outer surface of said tubular body adjacent to said one end; and a release strip removably engaged between said flange and the outer surface of said tubular body so that said flange will be released from said tubular body when said release strip is removed, said release strip having an elongate portion with a first side edge which is engaged between said flange and said tubular body, said first side edge of said elongate portion terminating at a shoulder, and a tab portion extending from said elongate portion generally adjacent to said tubular body for grasping and pulling by the consumer to remove the release strip, said tab portion having a neck portion and a head portion connected to said neck portion, said neck portion defining an axially recessed contour facing said end closure which begins at said shoulder and terminates at said head portion such that at least a part of said head portion is closer to said end closure than the recessed contour of said neck portion.

17. A tubular container as defined in claim 16 wherein said head portion is not engaged between said flange and said tubular body.

18. A tubular container as defined in claim 16 wherein said neck portion further defines a generally convex contour opposite the recessed contour and having a shape corresponding to the shape of the recessed contour.

19. A tubular container as defined in claim 16 wherein said first side edge of said elongate portion defines an imaginary circumferential line extending about the periphery of the tubular container, and wherein at least a part of said head portion is sufficiently close to be within about 0.1 inches from the imaginary line.

20. A tubular container as defined in claim 16 wherein said tab portion is generally T-shaped and said head portion has a longitudinal dimension extending perpendicularly to said elongate portion.

21. A tubular container as defined in claim 16 wherein said head portion is offset and has a longitudinal dimension which extends at an acute angle relative to said elongate portion.

* * * * *